US010716379B2

(12) United States Patent
Ponti

(10) Patent No.: US 10,716,379 B2
(45) Date of Patent: Jul. 21, 2020

(54) LUGGAGE ARTICLE WITH LATERALLY ENGAGED ZIPPER PULL-TABS

(71) Applicant: Samsonite IP Holdings S.a r.l., Luxembourg (LU)

(72) Inventor: Andrea Ponti, Kowloon (HK)

(73) Assignee: Samsonite IP Holdings S.a r.l., Luxembourg (LU)

( * ) Notice: Subject to any disclaimer, the term of this patent is extended or adjusted under 35 U.S.C. 154(b) by 72 days.

(21) Appl. No.: 15/980,885

(22) Filed: May 16, 2018

(65) Prior Publication Data

US 2018/0332940 A1 Nov. 22, 2018

(30) Foreign Application Priority Data

May 16, 2017 (EP) ..... 17171282

(51) Int. Cl.

| | |
|---|---|
| ***A45C 13/18*** | (2006.01) |
| ***A45C 13/10*** | (2006.01) |
| ***A45C 5/14*** | (2006.01) |
| ***A44B 19/26*** | (2006.01) |
| ***A44B 19/30*** | (2006.01) |
| ***A45C 5/03*** | (2006.01) |

(52) U.S. Cl.

CPC ..... *A45C 13/103* (2013.01); *A44B 19/262* (2013.01); *A44B 19/301* (2013.01); *A44B 19/305* (2013.01); *A45C 5/03* (2013.01); *A45C 5/14* (2013.01); *A45C 13/1069* (2013.01); *A45C 13/18* (2013.01)

(58) Field of Classification Search

CPC ..... A45C 5/03; A45C 13/18; A45C 13/103; A44B 19/262; A44B 29/301

USPC ..... 190/903, 120; 24/303, 430, 585.12; 70/68

See application file for complete search history.

(56) References Cited

U.S. PATENT DOCUMENTS

| | | | | |
|---|---|---|---|---|
| 4,817,769 | A * | 4/1989 | Saliba | A44B 19/301 190/120 |
| 5,063,760 | A * | 11/1991 | Horita | A44B 19/301 70/23 |
| 6,467,135 | B1 * | 10/2002 | Schuster | A44B 19/262 24/381 |
| 6,510,593 | B1 * | 1/2003 | Kim | A44B 19/301 24/382 |
| 7,506,417 | B2 * | 3/2009 | Yoneoka | A44B 19/301 24/386 |

(Continued)

FOREIGN PATENT DOCUMENTS

| | | |
|---|---|---|
| CN | 201234621 Y | 5/2009 |
| CN | 104382302 A | 3/2015 |

(Continued)

OTHER PUBLICATIONS

"Arrive Bradley Backpack Zipper Feature shown in video advertisement", http://be.tumi.com/p/bradley-backpack-0255012D2, 2016, 3 pages.

*Primary Examiner* — Sue A Weaver
(74) *Attorney, Agent, or Firm* — Dorsey & Whitney LLP

(57) ABSTRACT

A luggage article, such as luggage case, with zipper pull-tabs laterally engaged along inner sides and separably secured by a magnetic force, without interlocking with each other, to allow enhanced manipulation of the zipper pull-tabs, zipper sliders and optionally improved operation of the lock mechanism.

15 Claims, 5 Drawing Sheets

(56) References Cited

U.S. PATENT DOCUMENTS

| | | | | |
|---|---|---|---|---|
| 2005/0109072 | A1* | 5/2005 | Ling | A44B 19/301<br>70/68 |
| 2013/0216085 | A1* | 8/2013 | Honeycutt | H04R 1/028<br>381/374 |
| 2014/0069757 | A1* | 3/2014 | Schlipper | A44B 19/06<br>190/113 |
| 2015/0014109 | A1 | 1/2015 | Lai | |

FOREIGN PATENT DOCUMENTS

| | | | |
|---|---|---|---|
| CN | 204742861 | U | 11/2015 |
| CN | 204812415 | U | 12/2015 |
| CN | 205597390 | U | 9/2016 |
| EP | 2002744 | A1 | 12/2008 |
| EP | 2384660 | A3 | 8/2012 |
| EP | 2710915 | A2 | 3/2014 |
| EP | 2926679 | A1 | 10/2015 |
| JP | 2013221357 | A | 10/2013 |
| WO | 2016100553 | A1 | 6/2016 |

* cited by examiner

LUGGAGE ARTICLE WITH LATERALLY ENGAGED ZIPPER PULL-TABS

CROSS-REFERENCE TO RELATED APPLICATION

This application claims priority to European Patent Application No. 17171282.1, filed May 16, 2017, entitled "Luggage Article With Laterally Engaged Zipper Pull-Tabs", which is hereby incorporated by reference herein in its entirety for all purposes.

TECHNICAL FIELD

The present invention relates to luggage articles, and in particular to laterally engaged zipper pull-tabs for luggage articles.

BACKGROUND

Luggage items, and in particular luggage cases (suitcases), often include zippers for various purposes, including for use in opening and closing complimentary luggage shells, as well as for use in opening and closing outer pockets, among other uses. The pull-tabs of a zipper may be secured in a lock mechanism mounted on the luggage case to thwart unauthorized access. Where a zipper has more than one pull-tab, such as having one pull-tab for each of two zipper sliders, the pull-tabs may require specific positioning relative to one another, such as by being interlocked together, in order to be received in the lock mechanism. This relative positioning, or interlocking, of the pull-tabs can be difficult to accomplish for many reasons, such as where the task lighting is inadequate, or where the pull-tabs must be engaged together in a specific manner, such as by being interlocked with the portion of one pull-tab being received in or inserted through a portion of another pull-tab. Additionally, a user may not have the dexterity required for manipulating the pull-tabs into the proper inter-engaged orientation for being received in the lock mechanism.

It is therefore desirable to provide an improved luggage case, and more specifically an improved zipper locking system for luggage cases configured with the improved automatically aligned pull-tabs, that addresses the above-described problems and/or which more generally offers improvements or an alternative to existing arrangements.

Documents that may be related to the present disclosure in that they include various carry handles include: EP2926679A1, EP2710915A2, EP2384660A3 (example of interlocking), WO/2016100553A1, CN104382302A, CN201234621Y, CN205597390U, CN204742861 U (example of interlocking), and CN204812415U.

SUMMARY

According to the present disclosure there is therefore provided a luggage article as described in the accompanying claims.

An improved zipper pull-tab engagement configuration, and/or a lock mechanism configured for use with the improved zipper pull-tab engagement configuration, and/or a luggage case configured for use with the improved zipper pull tabs in turn used with the lock mechanism, are disclosed herein that allows lateral engagement of the zipper pull-tabs for easier manipulation by a user. Additionally or alternatively, the disclosure allows for separably securing the zipper pull-tabs in the laterally engaging configuration using a magnetic force to allow orientation of the zipper pulls. Such lateral engagement of the zipper pull-tabs may be beneficial for more convenient handling by a user. Such lateral engagement of the zipper pull-tabs may also be beneficial for receipt in a lock mechanism without requiring a mechanical interlocking engagement in a particular manner, such as by a portion of one zipper pull being received into or through a portion of the other zipper pull. Additionally or alternatively, the disclosure may also allow for the zipper pulls to be aligned as required for receipt in a lock mechanism, and engagement of the aligned zipper pulls in the lock mechanism by a user having limited dexterity in his or her fingers or hands, or limited sight ability. Such lateral engagement of the zipper pull-tabs provides an improved appearance and a cleaner arrangement.

In one configuration, the zipper pull-tabs are aligned together by magnetic force. The magnetic force may be of a magnitude to hold the zipper pull-tabs lightly together, and allow for relatively easy separation from one another. In addition or separately, the zipper pull-tabs are laterally abutted with one another with no portions of either zipper pull-tab being mechanically interlocked with the other zipper pull-tab. Additionally or independently, the aligned zipper pull-tab as noted may be engaged with a lock mechanism.

This disclosure allows a user to more easily lock the zipper of a luggage article, such as for instance when the luggage article is in a low light environment, or where the user has limited dexterity of his or her fingers or hands. It is also improves the convenience and ease of locking the zipper, and reduces the risk of the combination of the lock mechanism being accidentally changed after the first zipper pull-tab is received in the lock receiver opening, but before the second zipper pull-tab is received in the lock receiver opening. The laterally engaged zipper pull-tabs as described herein facilitate the desired positioning and alignment, and may be manipulated as a single unit to engage the lock mechanism, to satisfy one of or a combination of these benefits.

In one arrangement, a luggage article includes a zipper including at least two zipper sliders, one of the at least two zipper sliders joined to a first zipper pull-tab comprising an elongated body, the elongated body having an outer side and an inner side and an engagement feature. The other of the at least two zipper sliders is joined to a second zipper pull-tab comprising an elongated body, the elongated body having an outer side and an inner side and an engagement feature. The first zipper pull-tab and the second zipper pull-tab are laterally engaged along at least a portion of their respective inner sides and are separably held in engagement by a magnetic force.

Additionally or alternatively, a lock mechanism may be coupled to the luggage article. The lock mechanism may be positioned on the luggage case and secured to one of the sides of the luggage case adjacent a zipper, or the lock mechanism may be independent from the luggage case, such as for example a pad lock. The lock mechanism may at least two zipper pull-tab receiver openings, where the at least two zipper pull-tab receiver openings each sized to receive one of the engagement features. The laterally engaged first zipper pull-tab and second zipper pull-tab positioning the engagement features for receipt in the at least two zipper pull-tab receiver openings. Additionally or alternatively, the engagement features may be received in the at least two zipper pull-tab receiver openings.

In another arrangement additional or alternative to the above, the first and second zipper pull-tabs are engaged by an abutment of the portions of the respective inner sides. In further addition, the abutment of the portions of the respective inner sides include facial abutment without interlocking of the first and second zipper pull-tabs.

In another arrangement additional to the above, the first zipper pull-tab and the second zipper pull-tab form a laterally-extending single unit.

A further arrangement includes a top side of the first zipper pull-tab being flush with a top side of the second zipper pull-tab, or a bottom side of the first zipper pull-tab being flush with a bottom side of the second zipper pull-tab.

In another arrangement, the laterally engaged portion of the inner side of each zipper pull-tab forms a wall extending at a substantially right angle to a top side of the respective zipper pull-tab.

In a further arrangement of the disclosure, the magnetic force includes at least a first magnet coupled with at least a portion of the inner side of the first zipper pull-tab, or at least a second magnet coupled with at least a portion of the inner side of the second zipper pull-tab, or at least a first magnet and at least a second magnet each coupled with at least a portion of the inner side of the first and second zipper pull-tabs, respectively. The first magnet may be coupled by being fully embedded within the portion of the first zipper pull-tab, and the second magnet may be coupled by being fully embedded within the portion of the second zipper pull-tab.

A further arrangement includes that the portion of the first inner side and/or the second inner side defines a recess, and the at least first magnet and/or the at least second magnet is received in the respective recess. Additionally, the first magnet and/or the second magnet are each flush, below flush, or above flush with the portion of the respective inner side.

Additionally, a layer may be positioned on at least the portion of the inner side of the first and/or second zipper pull-tab. The layer does not overlie the first and/or second magnet on the respective zipper pull-tab and exposes the first and/or second magnet on the respective zipper pull-tab.

In a further arrangement, the portions of respective inner sides of the first and second zipper pull-tabs define a linear shape or define complimentary curved shapes.

Additional arrangements, examples and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The present invention will now be described by way of example only with reference to the following figures in which.

DETAILED DESCRIPTION

Figure 1:
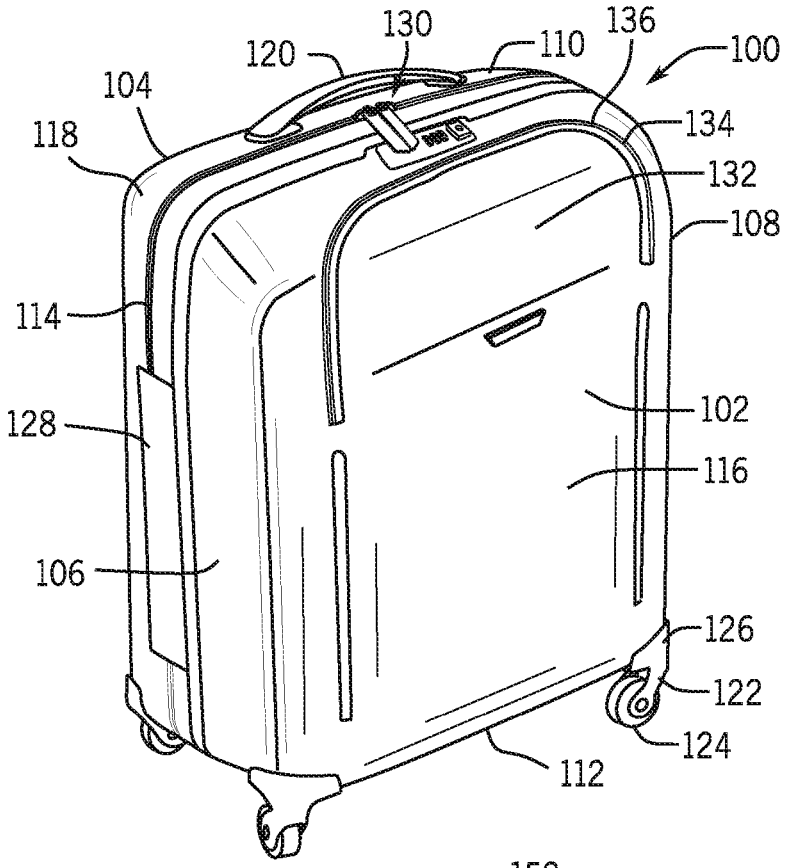
FIG. 1 is a front perspective view of a luggage case with automatically aligned zipper pull-tabs.

Referring to FIG. 1, an embodiment of a luggage article, such as luggage case 100, with laterally engaged zipper pull-tabs to allow improved handling of the joined zipper pull-tabs, and separately to allow improved operation of the lock mechanism of the luggage case is shown. The zipper pull-tabs may be configured to facilitate manipulation as a single unit when engaging the pull-tabs with the lock mechanism. The zipper pull-tabs may be aligned with one another, laterally engaged with one another along at least a portion of their inner sides, and releasably held in engagement with one another so as to form, at least temporarily, a single unit for easier manipulation by the user to lock the zipper on the luggage article. This lateral engagement and releasable securement allows the engaged zipper pull-tabs to be more easily aligned with the lock mechanism. Separately, the lateral engagement and releasable securement may allow the engaged zipper pull-tabs form a single unit to be more easily inserted into the lock mechanism to lock the zipper closed. In some examples, the zipper pull-tabs engage along at least a portion of their inner sides by an abutment of the inner side surfaces, with no interlocking between the zipper pull-tabs (such as by inserting a portion of one pull-tab into or through a portion of the other pull-tab). In this configuration, the zipper pull-tabs may be inserted into the lock mechanism simultaneously, or nearly simultaneously. This, in many instances, may make the locking of the zipper pull-tabs to the lock mechanism more simple. It may also aid in locking the zipper in low light environments, or where the user may have limited dexterity or limited sight abilities.

Continuing with FIG. 1, luggage case 100 includes a generally cuboid structure formed from multiple walls defining an enclosed internal volume of the luggage case 100 in which to store a user's belongings. The luggage case 100 may include opposing front and back walls 102, 104 forming major front and back faces of the luggage case 100, opposing side walls 106, 108 forming side faces of the luggage case 100, and opposing top and bottom end walls 110, 112 forming top and bottom faces of the luggage case 100. Collectively, the walls 102, 104, 106, 108, 110, 112 define an outer structure of the luggage case 100 that, in turn, defines the enclosed internal volume. As shown, the laterally engaged zipper pull-tabs may be engaged with a lock mechanism coupled with the luggage case. The lock mechanism may be positioned on the luggage case and secured to one of the sides of the luggage case adjacent a zipper, or the lock mechanism may be independent from the luggage case, such as for example a pad lock.

The luggage case 100 may be of a type generally known as a soft side case, a hard side case, or a hybrid type case. Alternatively the luggage case may also be a business case, laptop case or other similar case type with openings secured by zippers.

The luggage case 100 may be split along a generally vertical plane, relative to FIG. 1, with a first opening line 114 parallel to the major faces. The luggage case 100 may include a lid 116, which includes the front wall 102, and a base 118, which includes the back wall 104. In the embodiment shown in FIG. 1, the first opening line 114 may be located closer to the back face than the front face such, but may be located in other relative positions on the luggage case 100. A first zipper 130 positioned along a periphery of the first opening line 114 secures the lid 116 to the base 118 to open and close the luggage case 100. The luggage case 100 may include a telescoping extendable handle. The luggage case 100 may also include one or more fixed carry handle(s) 120 to facilitate carrying or lifting the luggage case 100. Wheel assemblies 122 may be mounted to at least one of the walls, often the bottom end wall 112, near the bottom end of the luggage case 100. Each wheel assembly 122 may be positioned proximate a corner of the luggage case 100. Each wheel assembly 122 may include one or more wheels 124 rotationally mounted to a fork bracket 126 to rotate about a wheel axis. The wheel axis may be generally horizontal and parallel to the bottom end wall 112 of the luggage case 100, and the fork bracket 126 may be rotationally mounted to the bottom end wall 112 of the luggage case 100 to rotate about a generally vertical axis that is perpendicular to the bottom end wall 112 of the luggage case 100. Such an arrangement allows the wheels 124 to rotate about two orthogonal axes: the horizontal wheel axis and the vertical axis.

In alternative embodiments, the wheel assemblies 122 may be replaced by a pair fixed-axis wheels mounted respectively near the back wall 104 of the luggage case 100. The fixed axis wheels rotate about a common, generally horizontal fixed axis, which is generally parallel to the back wall 104. Each of the fixed axis wheels may be located at a bottom end corner of the luggage case 100.

The lid 116 may be connected to the base 118 along on a sidewall via a hinge 128 in a conventional manner, and the luggage case 100 may be opened at the first opening line 114 by unzipping the zipper 130 to access the internal volume. The hinge 128 may be formed of a fabric strip, with or without a zipper or in any other known manner. In some examples, the luggage case 100 may be hinged along the left or the right side wall 106, 108, whereas in other examples, the luggage case 100 may be hinged along the bottom, or along any other face, of the luggage case 100.

The luggage case 100 may optionally further include a pocket 132 to separate the luggage case's enclosed interior into smaller spaces. The pocket 132 is shown as an external pocket, but may also be an internal pocket in some examples. The pocket 132 may be accessed through the outer surface of the luggage case 110 via a second opening line 134. The second opening line 134 may be selectively opened and closed, for instance in one example by using a second zipper 136 positioned along the second opening line 134.

Figure 2:
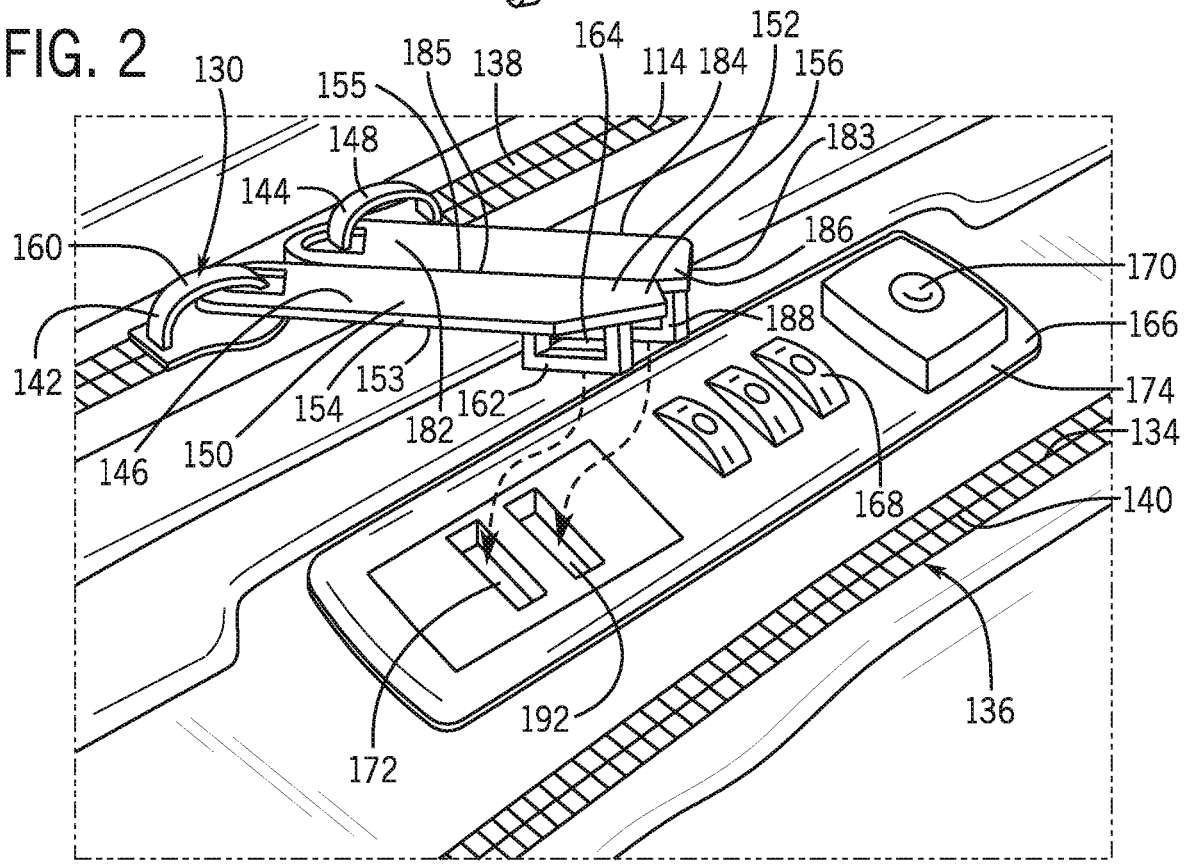
FIG. 2 is an enlarged perspective view of a top portion of the luggage case shown in FIG. 1, showing the aligned zipper pull-tabs prior to being joined to a lock mechanism.

With reference to FIG. 2, the first zipper 130 and optional second zipper 136 may include first and second zipper tracks 138, 140, respectively. Each of the first and second zipper tracks 138, 140 include a pair of zipper tapes with interlocking teeth that may be selectively interlocked using one or more zipper sliders. In the shown embodiment of the luggage case 100, the first zipper 130 includes a first zipper slider 142 having a first zipper pull-tab 146 attached thereto, and a second zipper slider 144 with a second zipper pull-tab 148 attached thereto. The second zipper 136 (see FIG. 4), where the optional second zipper is utilized, includes a first zipper slider 145 with a first zipper slider 149 attached thereto, and a second zipper slider 147 with a second zipper slider 151 attached thereto.

Continuing with FIG. 2, the first and second zipper pull-tabs 146, 148 are shown aligned and engaged along their inner sides 155, 185, and separably secured together to form a single unit to be manipulated by the user. In this configuration, the engagement features 162, 188, one extending from the bottom of each of the zipper pull-tabs, are aligned with a respective receiver opening 172, 192 in the lock mechanism 166.

Figure 3:
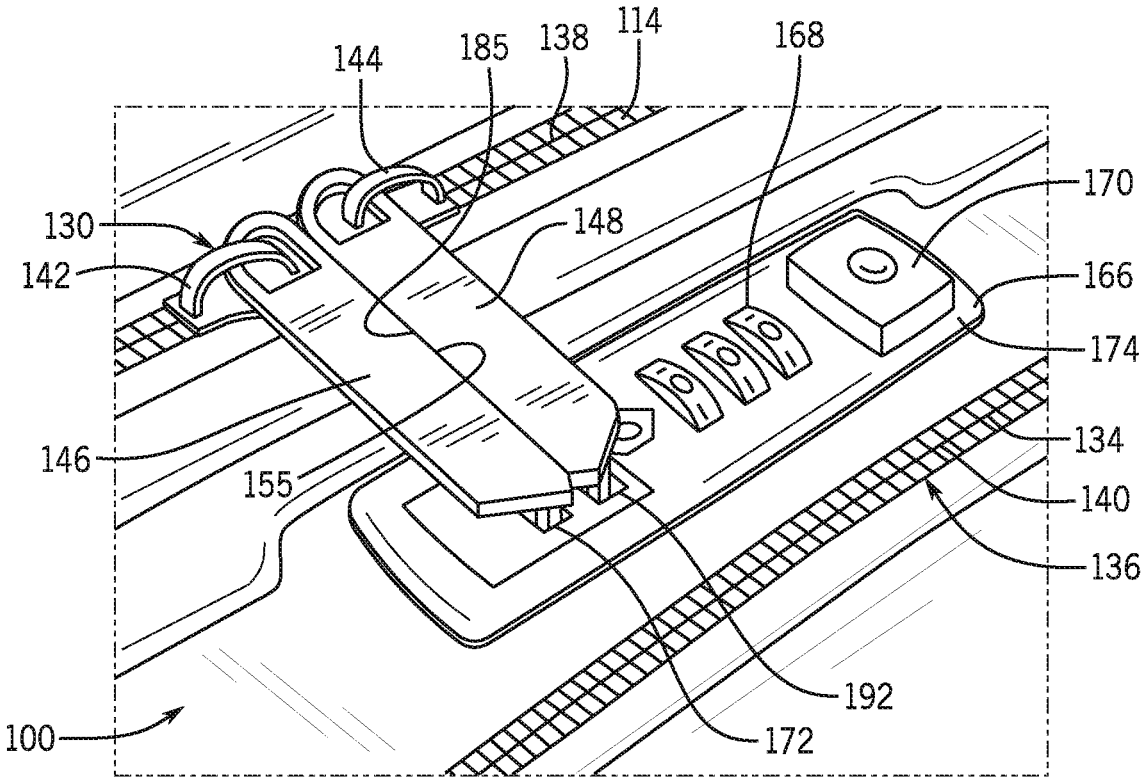
FIG. 3 is an enlarged perspective view of the top portion of the luggage case shown in FIG. 1, showing the aligned zipper pull-tabs engaged with the lock mechanism.

Referring to FIG. 3, when the engaged first and second zipper pull-tabs 146, 148 are moved down towards the lock mechanism 166 as a single unit, the engagement features 162, 188 are received in the respective receiver opening 172, 192 and secured to the lock mechanism 166 generally simultaneously, or nearly simultaneously. Alternatively from the configuration in FIG. 2, the first and second zipper pull-tabs may be laterally engaged together to form the single unit to aid the user in aligning the zipper pull-tabs over the receiver openings in the lock mechanism. Once aligned over the lock mechanism, the zipper pull-tabs may be separated from one another and each individually engaged with the respective receiving openings in the lock mechanism. In this alternative scenario, the lateral engagement of the zipper tabs enhances the user's ability to easily align the zipper tabs over the lock mechanism, even if the engagement of the zipper pull-tabs are not engaged with the lock mechanism as a single unit.

Figure 4:
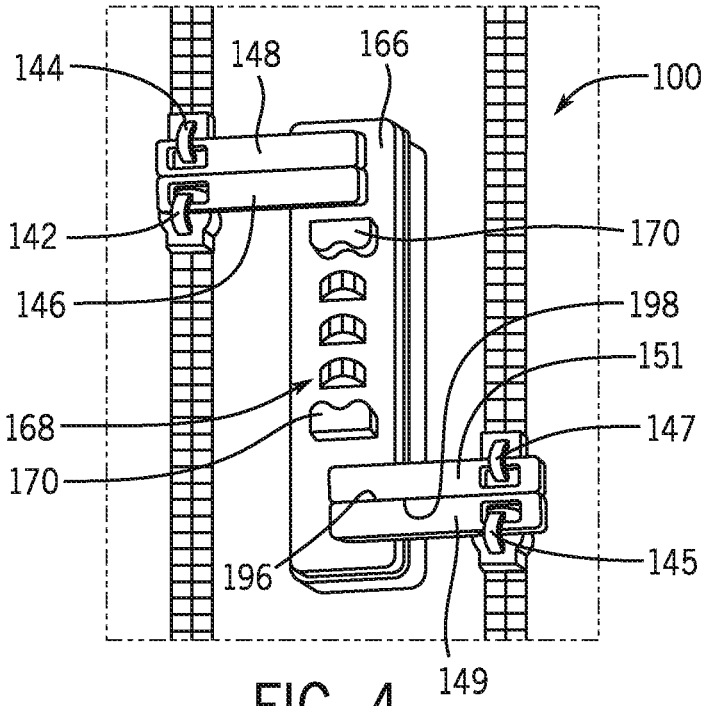
FIG. 4 is a partial view of two pair of aligned pull-tabs engaged with a lock mechanism.

FIG. 4 shows an alternative example of a luggage article having two zippers 130 and 136. The zipper pull-tabs 146, 148 are laterally engaged and separably secured along inner sides 155, 185 of the zipper pull-tabs, respectively, and in turn engaged with the lock mechanism 166. The zipper pull-tabs 145, 147 on the second zipper 136 are laterally engaged and separably secured along inner sides 196, 198 of the zipper pull-tabs, respectively, and in turn engaged with additional receiver openings formed in the lock mechanism 166.

Further referring to FIG. 2, the first zipper 130 includes a first zipper pull-tab 146, which may include a body 150. The second zipper pull-tab 148 may have a configuration similar to the first zipper pull-tab, and is described below. The body 150 may be an elongated body with upper 152 and lower 153 surfaces joined by an outer side wall 154 and an inner side wall 155 (see FIG. 5) of the body 150 that extend between the upper 152 and lower 153 surfaces. The upper 152 and lower 153 surfaces may be generally planar and parallel to each other as shown in FIG. 2 or may take other forms. The body 150 may include a length, which is defined by the distance from the first zipper slider 142 to a free end 156 of the first zipper pull-tab 146, and a width, which is defined by the distance between the sidewalls 154 and 155 of the elongated body 150. The length may be greater than the width. Such a configuration for the body 150 provides a relatively easy object for a user to grasp when using the first zipper pull-tab 146 to move the respective first zipper slider 142 along the first zipper track 138. Other configurations of the body 150 are possible so long as the body 150 provides a convenient object for a user to grasp in order to use the first zipper pull-tab 146 to move its respective first zipper slider 142 along the first opening line 114.

Similarly to the first zipper pull-tab 146, the second zipper pull-tab 148 included an elongated body 180 with upper 182 and lower 183 surfaces joined by an outer side wall 184 and an inner side wall 185 (see FIG. 5) of the body 180 that extend between the upper 182 and lower 183 surfaces. The upper 182 and lower 183 surfaces may be generally planar and parallel to each other as shown in FIG. 2. The body 180 may include a length, which is defined by the distance from the first zipper slider 144 to a free end 186 of the second zipper pull-tab 148, and a width, which is defined by the distance between the opposing outer sidewall 184 and inner sidewall 185 of the elongated body 180. The length may be greater than the width. Such a configuration for the body 180 provides a relatively easy object for a user to grasp when using the second zipper pull-tab 148 to move the second zipper sliders 144 along the first zipper track 138. Other configurations of the body 180 are possible so long as the body 180 provides a convenient object for a user to grasp in order to use the second zipper pull-tab 148 to move the respective zipper slider 144 along the first opening line 114. In one example, the body is made of cast zinc.

Each of the first and second zipper pull-tabs 146 may further include an engagement feature 162, 186 that extends downwardly from the body 150, 180, respectively. In some embodiments, the engagement feature 162, 188 may extend transversely from the lower surface 153, 183 of the body 150, 180 and generally parallel to the sidewalls 154, 184 of the body 150, 180. The engagement feature 162, 188 may define a lock opening 164, 190 (see FIG. 5) that can receive there through a pin, a hook, or the like of a lock mechanism 166 coupled with the luggage case 100 to secure the first and second zipper pull-tabs 146, 148 to the lock mechanism 166. The lock mechanism 166 may be positioned on the luggage case and secured to one of the sides of the luggage case adjacent a zipper or zippers, or the lock mechanism may be independent from the luggage case, such as for example a pad lock.

The engagement feature 162, 188 may be a loop, a projection, or any other suitable structure. When the engagement feature 162, 188 takes the form of a loop, the loop may be generally U-shaped, arch-shaped, or any other suitable shape and may be positioned proximate to the free end 156, 186 of the first and second zipper pull-tab 146, 148, respectively. The loop 162, either by itself or collectively with the body 150, may define the lock opening 164.

The lock mechanism 166 may include combination dials 168 and a keyhole 170. The lock mechanism 166 may further include zipper pull-tab receiver openings 172, 192 that are defined in a housing 174 of the lock mechanism 166 and that receive at least a portion of the engagement feature 162, 188 of the first and second zipper pull-tabs 146, 148, respectively. The zipper pull-tab receiver openings 172, 192 may each take the form of a slot, a hole, or any other suitable structure that can receive at least portion of the respective engagement feature 162, 188. In this and other examples, when the zipper pull-tabs are laterally engaged together along at least a portion of their inner sides, the engagement features are spaced apart by a distance defined to allow the engagement features 162, 188 to be received in the adjacent receiver openings 172, 192 of the lock mechanism 166.

In operation, and by example of the engagement of zipper pull-tab 146 with the lock mechanism 166, once a sufficient portion of the engagement feature 162 is positioned within the zipper pull-tab receiver opening 172, the pin, hook, or the like contained within the housing 174 of the lock mechanism 166 may be positioned through the lock opening 164 to prevent removal of the engagement feature 162 from the zipper pull-tab receiver opening 172, and thus secure the first zipper pull-tab 146 to the lock mechanism 166. The lock mechanism 166 and first zipper pull-tab 146 are further configured such that the first zipper pull-tab 146 cannot be removed from the zipper pull-tab receiver opening 172 in the lock mechanism 166 until the pin, the hook, or the like is removed from the lock opening 164, thus effectively securing the first zipper pull-tab 146 to the lock mechanism 166. Moreover, once the pin, the hook, or the like is positioned within the lock opening 164, movement of the pin, the hook, or the like out the lock opening 164 is prevented unless a user first enters the correct combination using the lock's combination dials 168 or utilizes a key inserted into the keyhole 170 to unlock the lock mechanism contained within the housing 174 of the lock mechanism 166. In one example, one or more magnets may be coupled in or with the lock mechanism housing to attract either one or both of the zipper pull-tabs to aid in positioning the zipper pull-tabs relative to the lock mechanism either individually or when laterally engaged together.

Figure 5:
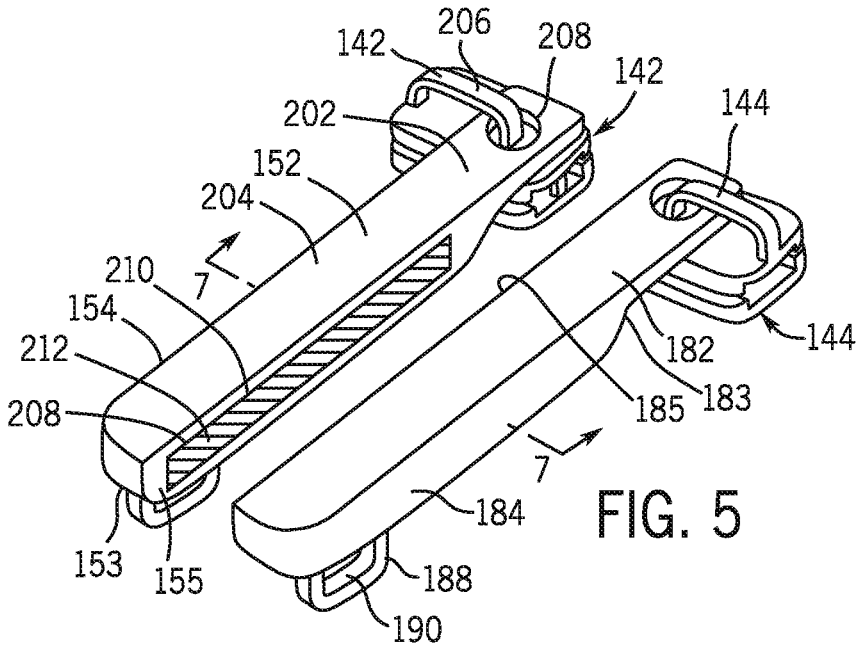
FIG. 5 is an enlarged view of the first and second zipper pull-tabs prior to lateral engagement.

The zipper pull-tabs 146, 148, and in particular the structure of the inner sides and the lateral engagement are shown in more detail in FIGS. 5-8, in a relative position prior to being laterally engaged and separably secured together. As best shown in FIG. 5, the inner side 155, 185 of each zipper pull-tab 146, 148 may be a wall having a height defined by the upper and lower surfaces of the respective zipper pull-tab, and a length defined by the length of the main body 150, 180 of the respective zipper pull-tab. The inner side of each zipper pull-tab is configured to laterally engage the other in a releasably securable manner (see FIG. 6) to form a single unit formed by the two zipper pull-tabs, and separably held together by a magnetic force. In one example, when the two zipper pull-tabs are relatively close together, for instance in one example within approximately ½ inch of each other, the magnetic attraction between the zipper pull-tabs causes the pull tabs to automatically laterally engage along at least a portion of the respective inner sides and form a laterally extending single unit. The lateral engagement between the inner sides may in one example be by facial abutment of the walls defining the inner sides, and is absent any interlocking structural engagement between the zipper pullers. The magnetic force, in one example, is a magnetic force applied between the inner sides of the two zipper pull-tabs. The magnetic force is separable by a user, for instance so that the two zipper pull-tabs may be used independently to move their respective sliders along the zipper when not engaged in the lock mechanism 166. In another example, the two zipper pull-tabs may automatically laterally engage along at least a portion of their respective inner sides when the respective sliders 142, 144 are adjacent one another, such as for example engaging one another, on the zipper 130. The magnetic force may be of a magnitude to hold the zipper pull-tabs lightly together, and may allow for relatively easy separation from one another without the need to disentangle the zipper pull-tabs from one another. This is easier to accomplish compared to separating mechanically interlocked zipper pull-tabs by disentangling one zipper pull tab from the other.

As shown in FIG. 5, the inner side 155 of the zipper pull-tab 146 extends along the length of the zipper pull-tab. In this example, the inner side has a first portion 202 defining a first thickness along approximately 25% of the length of the zipper pull-tab, and a second portion 204 defining a second thickness along the approximately remaining 75% of the length of the zipper pull-tab. The first portion 202 of the first zipper pull-tab 146 is coupled to the slider 142 by a clip 206 on the slider 142 received through an oversized aperture 208 formed in the first portion 202. The second zipper pull-tab 148 is coupled with the slider 144 in the same manner. This allows the zipper pull-tab 146 to move relative to the slider 142 and facilitates alignment and engagement with the other zipper pull 148. In this example, the inner wall 185 of the second zipper pull-tab 148 has a similar structure.

Continuing with FIG. 5, a recess 208 having an opening 210 is formed in the second portion 204 of the zipper pull-tab 146, in which a magnet 212 is received. In this example, the recess 208 defines a length dimension that extends along the majority of the length of the second portion 204, which is more than half of the entire length of the zipper pull-tab 146, and more specifically may be approximately 65% of the length of the zipper pull-tab. The magnet 212 positioned within the recess 208 extends generally in both the length and height dimensions of the recess 208, and has a magnet exposed through the opening 210 of the recess. In this example, and as shown best in FIG. 7, the inner wall 185 of the second zipper pull-tab 148 also defines a recess 214 having an opening 216 in which a magnet 218 is also received. However the magnet 218 is oriented such that the opposite pole compared to that exposed by magnet 212 in the first zipper pull-tab 146 is oriented to the opening of the recess. The magnets may be secured in the respective locations in the zipper pull tabs by being formed into position when the zipper pull-tab is cast into shape, or may be secured in the recesses with adhesives or by mechanical means, such as press fit or wedge inserts. The magnets may, in some embodiments, be fully embedded and entirely covered in the body of the zipper pull-tab, such as in one instance when they are cast in place into the zipper pull-tab. The magnets described for use herein include permanent magnets.

Figure 6:
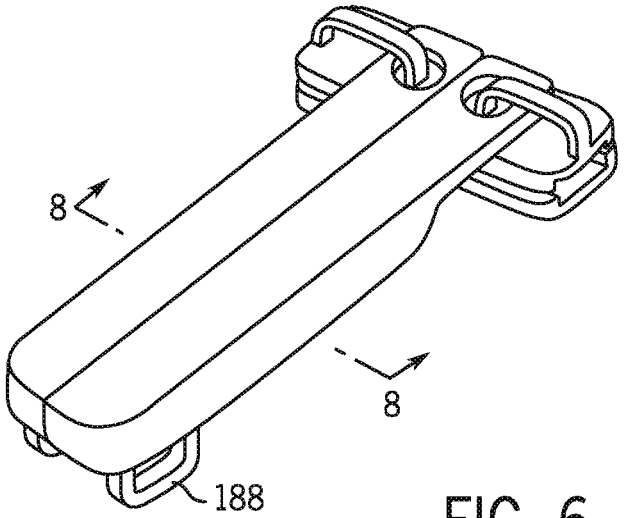
FIG. 6 is an enlarged view of the first and second zipper pull-tabs upon lateral engagement.

Referring to FIG. 6, the first zipper pull-tab 146 and the second zipper pull-tab 148 are shown laterally engaged along their respective inner sides, and separably secured together by the magnetic force created between the opposite poles of the magnets positioned in the opposing inner sides. The inner sides are engaged in this example by a facial abutment between the two inner sides. The facial abutment, in this one example, is along the length of the second portion of each zipper pull-tab. The facial abutment is without any mechanical interlocking between the first and second zipper pull-tabs, and the separable securing force is required to keep the laterally engaged zipper pull-tabs in lateral engagement. In other words, without the separable securing force, in this example the magnetic force, applied between the two zipper pull-tabs of this example, the first and second zipper pull-tabs would not remain in lateral engagement with one another if disturbed.

Figure 7:
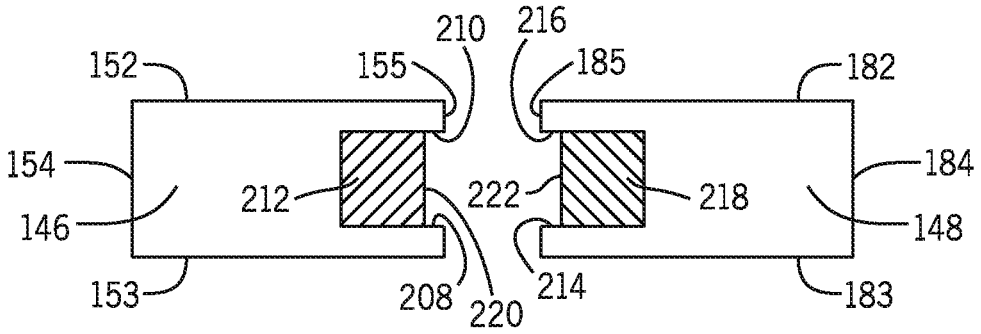
FIG. 7 is cross-section taken along line 7-7 of FIG. 5.

FIG. 7 is a cross section taken along line 7-7 of FIG. 5, and shows the two zipper pull-tabs 146 and 148 prior to lateral engagement. The magnet 212 is positioned in the recess 208 of zipper pull-tab 146, with the outer face 220 of the magnet 212 recessed from the inner side 155. Similarly, the magnet 218 is positioned in recess 214 with its outer face 222 recessed from the inner side 185. As noted above, the outer face 220 of magnet 212 is the opposite pole relative to the outer face 222 of the magnet 218. The opposite poles of the magnets, when positioned reasonably close together, such as within approximately one-quarter to one-half inch proximity, will attract each other and create the separable securing force to cause the two zipper pull-tabs to automatically laterally engage along at least a portion of the respective inner sides.

Figure 8:
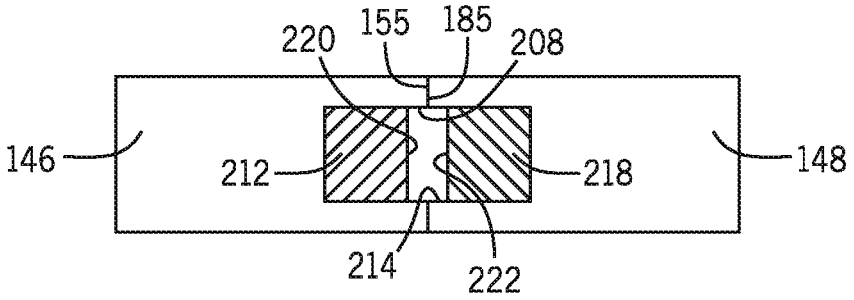
FIG. 8 is cross section taken along line 8-8 of FIG. 6.

FIG. 8 is a cross section taken along line 8-8 of FIG. 6, and shows the two zipper pull-tabs 146 and 148 upon lateral engagement of the respective inner sides under the separable magnetic force created by the magnets 212 and 218 in this example. The inner sides of the zipper pull-tabs 146 and 148 engage along a portion of their lengths, in this example at least the respective $2^{nd}$ portions. Specifically referring to FIG. 8 the portions of the inner side 155 of the zipper pull-tab 146 above and below the recess 208 engage in a facially abutting manner the portions of the inner side 185 of the zipper pull 148 above and below the recess 214. The parts of the second portion 204 of the first pull-tab 146 at either end of the recess 208 may also facially abut the corresponding parts of the second portion at either end of the recess 214 of the zipper pull-tab 148. The gap formed between the outer face 220 of magnet 212 and outer face 222 of magnet 218 allows for sufficient magnetic force to hold the two zipper pull-tabs together, and also allows for the size tolerance of the magnets positioned in the recess to vary somewhat without degrading performance. In this laterally engaged configuration, the engagement portions 162, 188 of the zipper pull tabs 146, 148, respectively, are spaced apart laterally a distance sufficiently similar to, or equal to, the receiver openings 172, 192 of the lock mechanism 166. This spacing allows the laterally engaged zipper pull-tabs 146, 148 to be moved downwardly towards the lock mechanism and position the engagement portions in the receiver openings 172, 192 of the lock mechanism. When in this laterally engaged configuration, in one example the zipper pull tabs 146, 148 may be generally vertically aligned, such as for instance the top sides 152, 182 may generally be flush with each other, and/or the bottom sides 153, 183 may generally be flush with each other, and/or the bottom portion of each of the engagement portions 162, 188 are generally flush with each other (See FIG. 2). These surfaces may, in other examples, not be flush with each other.

Also shown in FIGS. 7 and 8 are that the laterally engaged portion of the inner side of each zipper pull-tab forms a wall extending at a substantially right angle to a top side 152, 182 of the respective zipper pull-tab. The interface between the inner sides 155 and 185 of each of the zipper pull-tabs is shown here, and in the other examples, as having an interface defining a relatively vertical (with respect to the orientation of the figures) extension.

Figure 9:
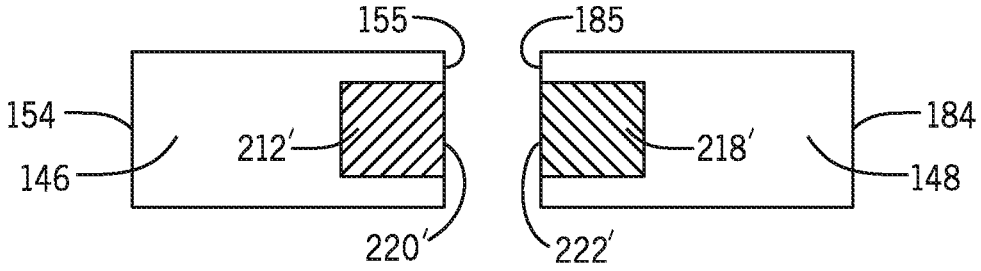
FIG. 9 is a representational cross section similar to that of FIG. 7.
Figure 10:
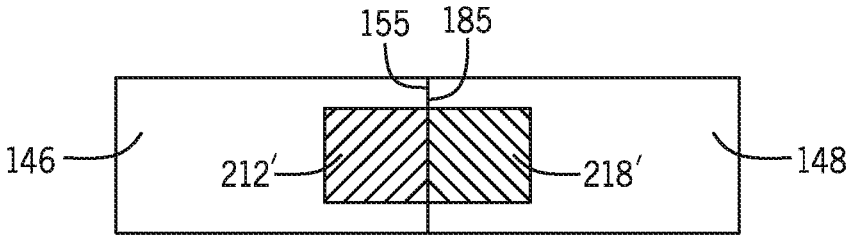
FIG. 10 is a representational cross section similar to that of FIG. 8.

FIGS. 9 and 10 are representative schematic figures similar to FIGS. 7 and 8, and show the magnets 212' and 218' sized and or positioned so that their outer surfaces 220' and 222' are relatively flush with the inner side 155 and 185, respectively. Upon engagement of the two zipper pull-tabs 146 and 148, the outer faces 220' and 222' may also engage. As shown in this example this lateral engagement is also defined by a facial abutment of the inner sides 155 and 185.

Figure 11:
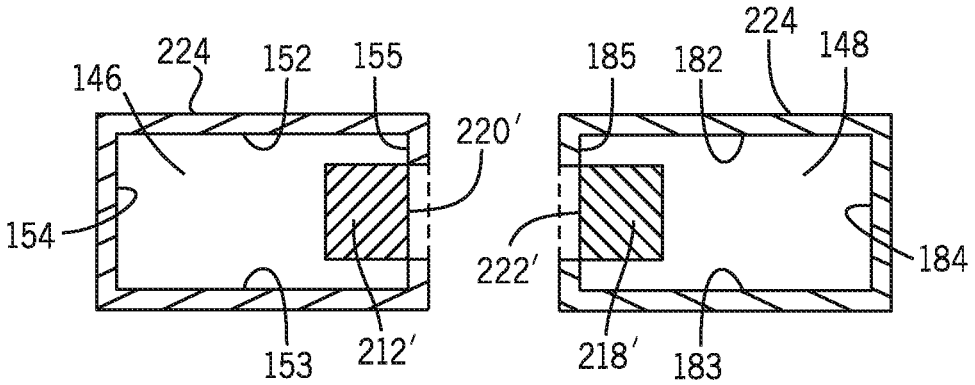
FIG. 11 is a representational cross section similar to that of FIG. 9, but showing a layer applied to the outer surface of each zipper pull-tab.
Figure 12:
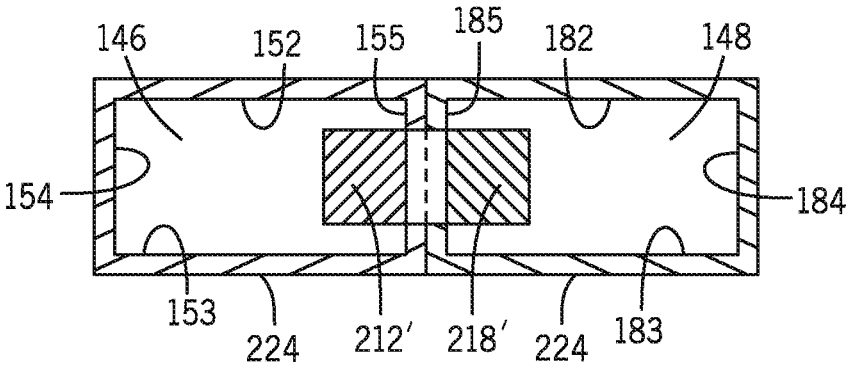
FIG. 12 is a representational cross section similar to that of FIG. 10, but showing a layer applied to the outer surface of each zipper pull-tab.

FIGS. 11 and 12 are representative schematic figures similar to FIGS. 9 and 10, and show that a layer 224 of material may be applied to the zipper pull-tabs 146, 148. The layer 224 of material may be a layer of a single material, or may be a lamina of more than one material layer. Example layers may include a material applied to the outer surface of the zipper pull-tab, such as be dip-moulding or over-moulding, or the like, to enhance the gripping characteristics of the zipper pull-tabs. The layer 224 may extend over the inner side portions above and below the magnets 212 and 218, but not extend over the outer surfaces 220' and 222' of the magnets 212', 218' (regardless of whether the outer surfaces of the magnets are inset or flush). Alternatively, as shown by the dashed lines in FIGS. 11 and 12, the layer 224 of material may extend over the outer surfaces 220' and 222' (regardless of whether the outer surfaces of the magnets are inset or flush). The layer 224 covering the outer surfaces 220' and 222' may protect the magnets from damage from use and prolong their useful life. The layer 224 may not appreciably affect the separable magnetic force applied between the zipper pull-tabs. The strength of the magnet may be modified to offset any degradation. In another example, the magnets 212 and 218 may be entirely embedded inside the body of the zipper pull-tab near the inner side.

While the zipper pull-tabs are described above as both including a magnet or magnets, in another example only one zipper pull-tab may have a magnet or magnets coupled with it, with the other pull-tab having at least a ferromagnetic metal construction along the inner side of the other zipper pull-tab to be attracted to cause engagement of the two inner sides under the magnetic force from the magnet.

The magnets described above need not be positioned in recesses formed in the inner sides of the adjacent zipper pull-tabs. Instead, a magnet or magnets may be coupled with the wall forming the inner side of one or both of the zipper pull-tabs, without the magnet(s) being positioned within a recess(es). One or more magnets may be coupled to each of one or both of the respective inner sides by an adhesive or other type of fastener. Alternatively, one zipper pull-tab may have a magnet coupled to the inner side without being positioned in a recess, and one zipper pull-tab may have a magnet coupled to the inner side of the other zipper pull-tab by being positioned in a recess. The layer 224 may be applied over the zipper pull-tab regardless of the manner of coupling the magnet to the zipper pull-tab.

In other examples, the separable magnetic force may be applied along at least a part of the length of the inner sides, along the entire length of the inner sides, or along more than one (a plurality of) discrete regions formed along a portion or all of the length of the inner sides. For example, the separable magnetic force may be applied along a length that ranges from approximately 100% of the length of the inner side of a zipper pull-tab, to less than 10% of the length of the zipper pull-tab. The separable magnetic force may also be applied between the second portions of the zipper pull-tabs, or may also be applied between the first portions of the zipper pull-tabs, or may be applied continuously between both or all portions. Alternatively, the separable magnetic force may be applied in more than one region of the inner side of the zipper pull-tab, including more than one region in the first portion, more than one region in the second portion, or one or more region in each of the two portions. In some examples, there may be no recess formed in the sidewall. Alternatively, where a magnet is used to create the separable magnetic force, more than one magnet may be used on each zipper pull-tab. Where a magnet is utilized with a recess, a magnet may be shorter than the length of the recess, and may be less tall than the height of the recess, and more than one magnet may be positioned in a recess.

The separable magnetic force may include having at least one of the zipper pull-tabs magnetized in a manner that it attracts the other zipper pull-tab, which other zipper pull-tab is made at least partially of ferromagnetic material, and having a sufficient separable magnetic force to cause the lateral engagement between the zipper pull-tabs without any interlocking structure, and form a single unit suitable for manipulation for aligning with the lock mechanism, and additionally engaging the lock mechanism. The orientation of the magnets along the inner sides of the zipper pull tabs, in each embodiment, may be oriented as desired to create the preferred magnetic force effect between the zipper pull-tabs.

The inner sides of each of the zipper pull-tabs, for example 146, 148, are represented as being generally at right angles to the top and bottom sides of the respective zipper pull-tabs. With this configuration, when laterally engaged the zipper inner sides are aligned vertically relative to one another, such as is shown in FIG. 8. The inner sides may be at other than right angles to the top and bottom sides of the respective zipper pull-tab, however the angle of one sidewall relative to its respective top and bottom sides may need to be complimentary to the angle of the other inner side relative to its top and bottom sides such that when laterally engaged the top and bottom sides may remain relatively flush or planar.

In a further arrangement, the portions of respective inner sides of the first and second zipper pull-tabs define a linear shape. They may also define a define complimentary curved shapes, with the curved shapes being in a vertical plane, such as that represented by the interface of the inner sides shown in FIGS. 7-12. Curves in a vertical plane would create facially abutting lateral engagements akin to the straight-walled engagement shown in FIGS. 7-12, and would not form interlocking structures.

The apparatuses and associated methods in accordance with the present disclosure have been described with reference to particular embodiments thereof in order to illustrate the principles of operation. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described and are thus within the spirit and scope of this disclosure. Accordingly, it is intended that all such alterations, variations, and modifications of the disclosed embodiments are within the scope of this disclosure as defined by the appended claims.

Where appropriate, common reference words are used for common structural and method features. However, unique reference words are sometimes used for similar or the same structural or method elements for descriptive purposes. As such, the use of common or different reference words for similar or the same structural or method elements is not intended to imply a similarity or difference beyond that described herein.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The principle and mode of operation of this invention have been explained and illustrated in its preferred embodiments. However, it must be understood that this invention may be practiced otherwise than as specifically explained and illustrated without departing from its spirit or scope.

The invention claimed is:

1. A luggage article comprising:

a zipper including at least two zipper sliders;

one of the at least two zipper sliders joined to a first zipper pull-tab comprising an elongated body, the elongated body having an outer side and an inner side;

another of the at least two zipper sliders joined to a second zipper pull-tab comprising an elongated body, the elongated body having an outer side and an inner side;

at least one magnet coupled with either or both of the first zipper pull-tab and/or the second zipper pull-tab; and the first zipper pull-tab and the second zipper pull-tab laterally engaging along at least a portion of their respective inner sides without interlocking with each other and held in engagement by a magnetic force.

2. The luggage article of claim 1, further comprising:

the first zipper pull-tab including an engagement feature;

the second zipper pull-tab including an engagement feature;

a lock mechanism coupled to the luggage article, the lock mechanism including at least two zipper pull-tab receiver openings, the at least two zipper pull-tab receiver openings each sized to receive one of the engagement features; and the laterally engaged first zipper pull-tab and second zipper pull-tab positioning the engagement features for receipt in the at least two zipper pull-tab receiver openings.

3. The luggage article of claim 2, wherein the engagement features are received in the at least two zipper pull-tab receiver openings.

4. The luggage article of claim 1, wherein the first and second zipper pull-tabs are engaged by an abutment of the portions of the respective inner sides.

5. The luggage article as defined in claim 4, wherein the abutment of the portions of the respective inner sides include facial abutment without interlocking of the first and second zipper pull-tabs.

6. The luggage article of claim 1, wherein the first zipper pull-tab and the second zipper pull-tab form a laterally-extending single unit when held in engagement by the magnetic force.

7. The luggage article of claim 1, wherein one or both of a top side and/or bottom side of the first zipper pull-tab is flush with a top side and/or bottom side, respectively, of the second zipper pull-tab.

8. The luggage article of claim 1, wherein the laterally engaged portion of the inner side of each zipper pull-tab forms a wall extending at a substantially right angle to a top side of the respective zipper pull-tab.

9. The luggage article as defined in claim 1, wherein the magnetic force includes at least a first magnet coupled with at least a portion of the inner side of the first zipper pull-tab, or at least a second magnet coupled with at least a portion of the inner side of the second zipper pull-tab, or at least a first magnet and at least a second magnet each coupled with at least a portion of the inner side of the first and second zipper pull-tabs, respectively.

10. The luggage article as defined in claim 9, wherein the portion of the first inner side and/or the second inner side defines a recess, and the at least first magnet and/or the at least second magnet is received in the respective recess.

11. The luggage article as defined in claim 9, wherein the at least first magnet is fully embedded in the portion of the first inner side and/or the at least second magnet is fully embedded in the portion of the second inner side.

12. The luggage article as defined in claim 10, wherein the first magnet and/or the second magnet are each flush, below flush, or above flush with the portion of the respective inner side.

13. The luggage article as defined in claim 1, wherein a layer is positioned on at least part of the portion of the inner side of the first and/or second zipper pull-tab.

14. The luggage article as defined in claim 1, wherein the portions of respective inner sides of the first and second zipper pull-tabs define a linear shape or define complimentary curved shapes.

15. The luggage article as defined in claim 2, wherein the lock mechanism is attached to a side wall of the luggage article or the lock mechanism is independent from the luggage article.

* * * * *